US005499408A

United States Patent [19]

Nix

[11] Patent Number: 5,499,408

[45] Date of Patent: Mar. 19, 1996

[54] APPARATUS FOR LIFTING INVALIDS

[76] Inventor: John W. Nix, 2360 Freshwater Rd., Haw River, N.C. 27258

[21] Appl. No.: 303,484

[22] Filed: Sep. 9, 1994

[51] Int. Cl.[6] ..... A61G 7/10

[52] U.S. Cl. ..... 5/85.1; 5/89.1; 5/83.1

[58] Field of Search ..... 5/81.1–89.1

[56] References Cited

U.S. PATENT DOCUMENTS

| | | | |
|---|---|---|---|
| 616,282 | 12/1898 | Allen | 5/89.1 |
| 669,450 | 3/1901 | Stephens | 5/85.1 |
| 2,272,778 | 2/1942 | Reuter | 5/85.1 |
| 2,793,768 | 5/1957 | Schaedler | 5/83.1 |
| 4,627,119 | 12/1986 | Hachey et al. | 5/83.1 |
| 4,739,526 | 4/1988 | Hollick | 5/83.1 |
| 5,023,968 | 6/1991 | Diehl et al. | 5/81.1 |
| 5,068,931 | 12/1991 | Smith | 5/84.1 |
| 5,072,840 | 12/1991 | Asakawa et al. | 212/205 |
| 5,158,188 | 10/1992 | Nordberg | 212/209 |

*Primary Examiner*—Alexander Grosz
*Attorney, Agent, or Firm*—Rhodes Coats & Bennett

[57] ABSTRACT

A lift for an invalid for moving the invalid between a first horizontal and a second sitting position. The apparatus includes an overhead frame extending over the first and second positions. A hoist assembly is supported by the frame and includes independently operable first and second retractable sling frame supports. The apparatus also includes a sling frame. The sling frame includes a central framework with opposed upper and lower ends. Parallel sides join the upper and lower ends. Upper and lower attachments connect the sling frame to the hoist assembly. Upper and lower support legs are attached to the central framework and are adapted to rest on a surface, such as a bed, at the first horizontal position. Sling attachments connect a sling beneath the frame. The sling attached beneath the sling frame includes a head support section, a trunk support section, and a pair of leg support sections.

21 Claims, 4 Drawing Sheets

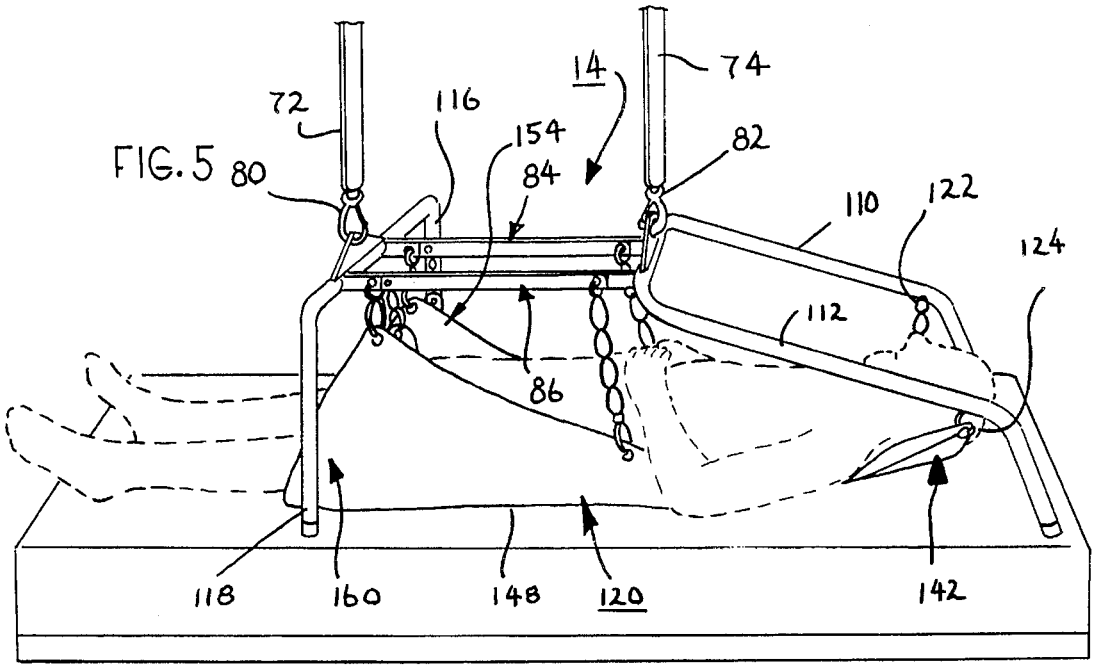
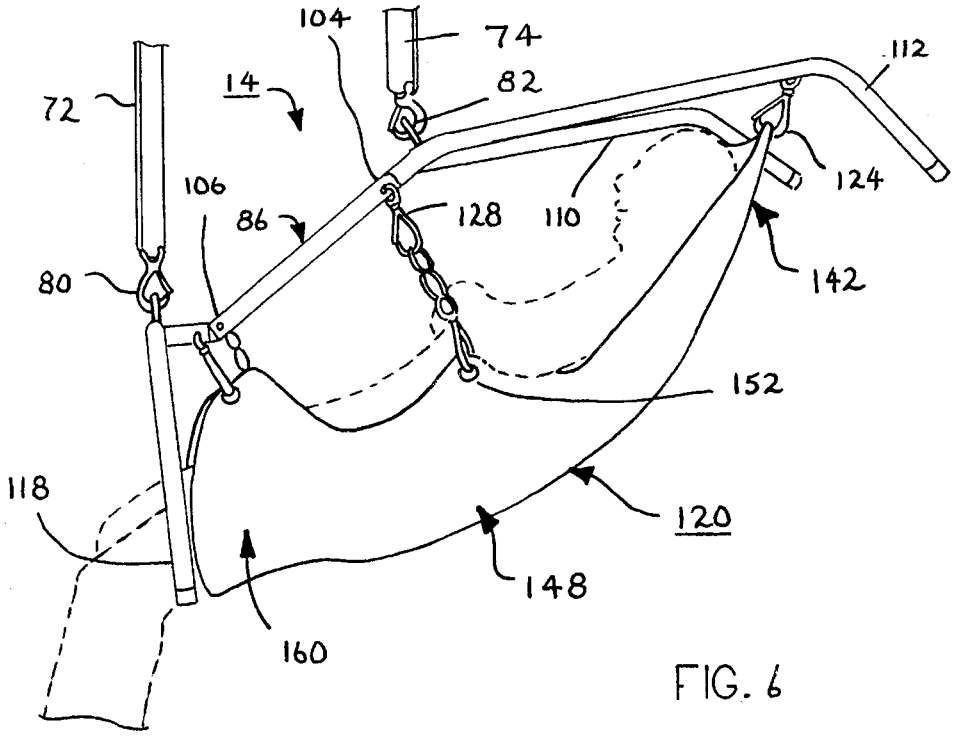
FIG. 6

APPARATUS FOR LIFTING INVALIDS

BACKGROUND OF THE INVENTION (1) Field of the Invention

The present invention relates generally to medical beds and, more particularly, to an apparatus for lifting an invalid to and from a bed and a wheelchair.

(2) Description of the Prior Art

Invalids must be moved often from their bed to a wheelchair or similar device in order to allow them some freedom of movement or to move them to another location for treatment. In general the patient is moved with the help of several persons but this may result in injury to the helpers or the invalid because of the weight of the invalid or his physical condition.

Various mechanical devices have been suggested but such devices either do not provide sufficient support for the patient's head and legs or are not adapted to move the patient between horizontal and setting positions.

Thus, there remains a need for a new and improved invalid lift which provides sufficient support for the patient's head and legs and, at the same time, is adapted to move the patient between horizontal and sitting positions.

SUMMARY OF THE INVENTION

The present invention is directed to a lift for an invalid for moving the invalid between a first horizontal and a second sitting position. The apparatus includes an overhead frame extending over the first and second positions. A hoist assembly is supported by the frame and includes independently operable first and second retractable sling frame supports. The apparatus also includes a sling frame.

The sling frame includes a central framework with opposed upper and lower ends. Parallel sides join the upper and lower ends. Upper and lower attachments connect the sling frame to the hoist assembly. Upper and lower support legs are attached to the central framework and are adapted to rest on a surface, such as a bed, at the first horizontal position. Sling attachments connect a sling beneath the frame.

The sling attached beneath the sling frame includes a head support section, a trunk support section, and a pair of leg support sections.

Accordingly, one aspect of the present invention is to provide an apparatus for moving an invalid between first and second positions. The apparatus includes: (a) an overhead frame extending over the first and second positions; (b) a hoist assembly supported by the frame, the assembly including independently operable first and second retractable sling frame supports; and (c) a sling frame having upper and lower frame attachments to connect the sling frame to the frame supports and sling attachments to connect a sling beneath the frame.

Another aspect of the present invention is to provide a sling frame for an apparatus for moving an invalid between first and second positions, the apparatus including an overhead frame extending over the first and second positions and a hoist assembly supported on the frame. The sling frame includes: (a) a central framework with opposed upper and lower ends, and parallel sides joining the upper and lower ends; (b) upper and lower attachments to connect the sling frame to the hoist assembly; (c) upper and lower support legs attached to the central framework and adapted to rest on a surface at the first horizontal position; and (d) sling attachments to connect a sling beneath the frame.

Still another aspect of the present invention is to provide an apparatus for moving an invalid between first and second positions. The apparatus includes: (a) an overhead frame extending over the first and second positions; (b) a hoist assembly supported by the frame, the assembly including independently operable first and second retractable sling frame supports; (c) a sling frame, the sling frame including: (i) a central framework with opposed upper and lower ends, and parallel sides joining the upper and lower ends; (ii) upper and lower attachments to connect the sling frame to the hoist assembly; (iii) upper and lower support legs attached to the central framework and adapted to rest on a surface at the first horizontal position; and (iv) sling attachments to connect a sling beneath the frame; and (d) a sling attached beneath the sling frame.

These and other aspects of the present invention will become apparent to those skilled in the art after a reading of the following description of the preferred embodiment when considered with the drawings.

BRIEF DESCRIPTION OF THE DRAWINGS

FIG. 5 illustrates the sling frame with an invalid in a horizontal position;

FIG. 6 illustrates the sling frame with an invalid being raised from a horizontal position to a sitting position.

DESCRIPTION OF THE PREFERRED EMBODIMENTS

Figure 1:
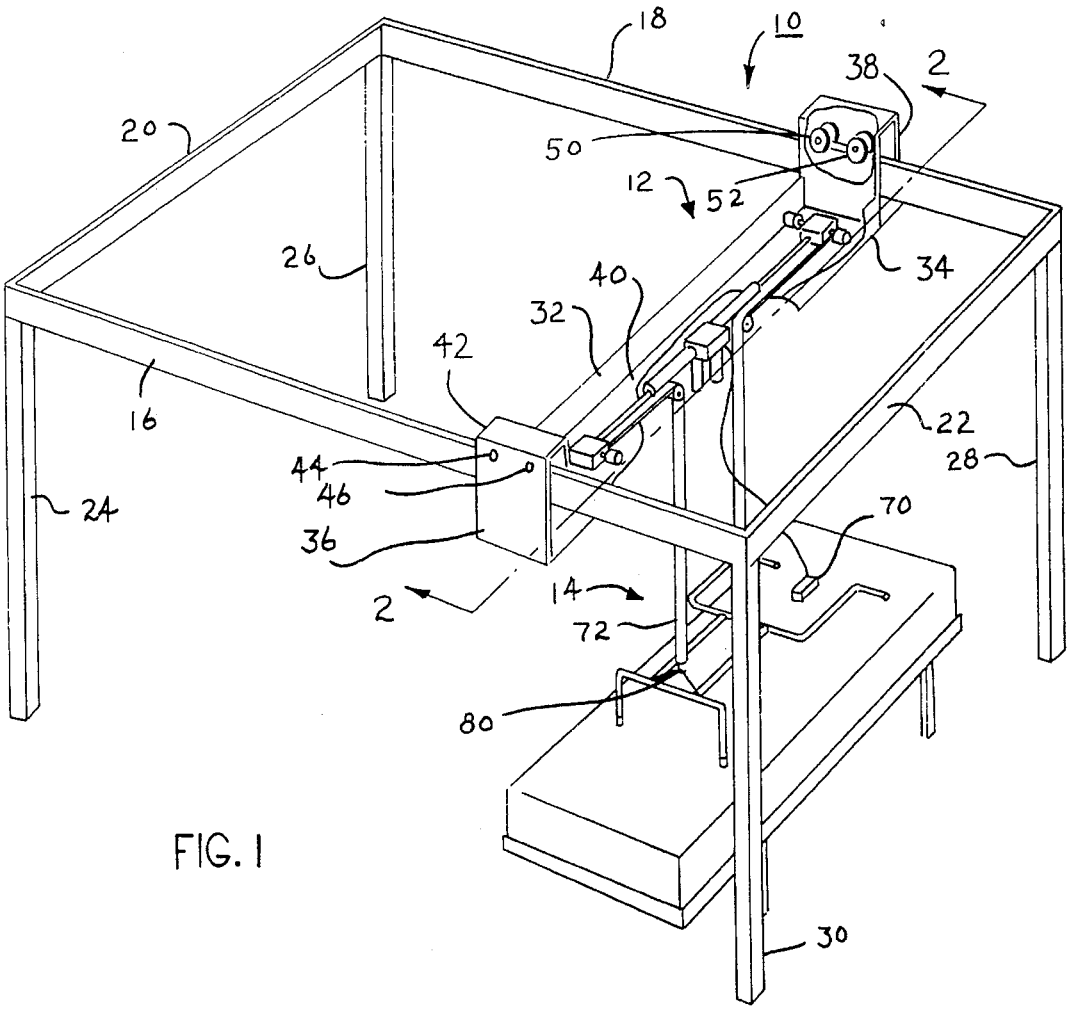
FIG. 1 is a perspective view of an invalid lift apparatus constructed according to the present invention, with sections cut away for clarity.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, the preferred apparatus includes an overhead frame, generally 10, extending over an area such as a patient's room, in which there is a first position including one patient horizontal support, e.g., a bed, and a second position which may contain a second patient setting support, e.g., a wheelchair. A hoist assembly, generally 12, is supported on frame 10, and a sling frame, generally 14, is suspended beneath hoist assembly 12.

Overhead frame 10 includes a pair of spaced, horizontal, parallel rails 16 and 18, joined at their ends by end rails 20 and 22. Support posts 24, 26, 28 and 30 support the rails 16–22 above the area floor.

Figure 2:
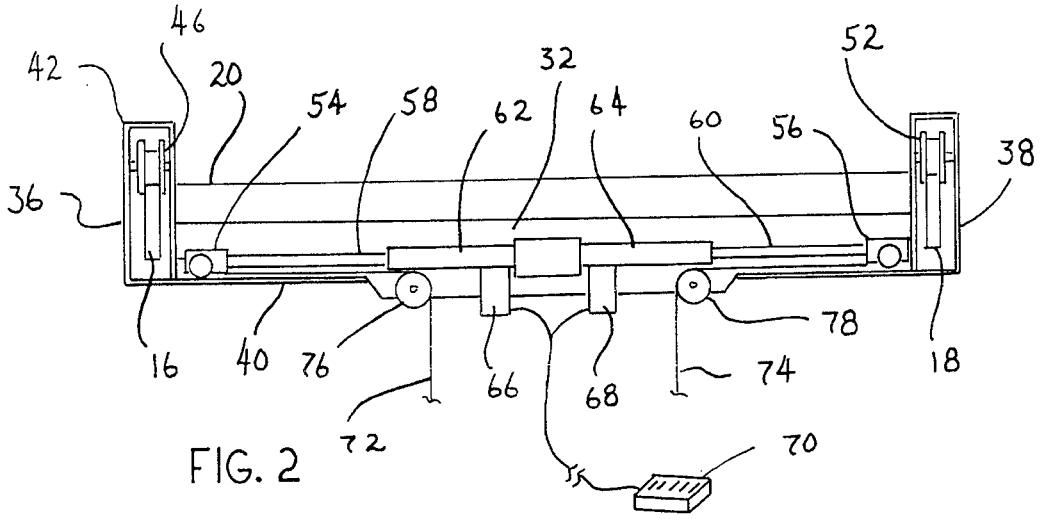
FIG. 2 is an end view of the hoist assembly forming a part of the apparatus of FIG. 1, taken along line 2—2.

As best seen in FIG. 2, hoist assembly 12 includes side walls 32 and 34, end walls 36 and 38, and a horizontal bottom wall or track 40 extending between rails 16 and 18.

A first hanger 42 extends upwardly from end wall 36 and over the top of rail 16. Wheels 44 and 46 are mounted on hanger 42 to roll along the top of rail 16 when assembly 12 is moved between the first and second positions. Similarly, a second hanger 48 extends upwardly from end wall 38 and over the top of rail 18. Wheels 50 and 52 are mounted on hanger 48 to roll along the top of rail 18.

First and second wheeled band clamps 54 and 56 are positioned within assembly 12 to ride along track 40. Clamps 54 and 56 are attached to the ends of first and second screw shafts 58 and 60, respectively, that are retractable or extendable, as the case may be, within shaft housings 62 and 64, respectively. A pair of motors 66 and 68 have shafts operably connected by gears (not shown) to screw shafts 58 and 60, respectively, so that activation of a motor rotates its shaft in a clockwise or counterclockwise direction, depending on the direction of current flow, and thereby extends or retracts the attached screw shaft. Activation of the motors and control the direction of current flow is by means of control box 70 wired into an electrical circuit with motors 66 and 68.

Hoist assembly 12 is attached to sling frame 14 with first and second bands 72 and 74, having upper ends clamped by clamps 54 and 56, respectively. Bands 72 and 74 extend inwardly from clamps 54 and 56 and downwardly over pulleys 76 and 78, respectively. Snap fasteners 80 and 82 are attached at the ends of bands 72 and 74, respectively, to connect bands 72 and 74 to sling frame 14.

Figure 3:
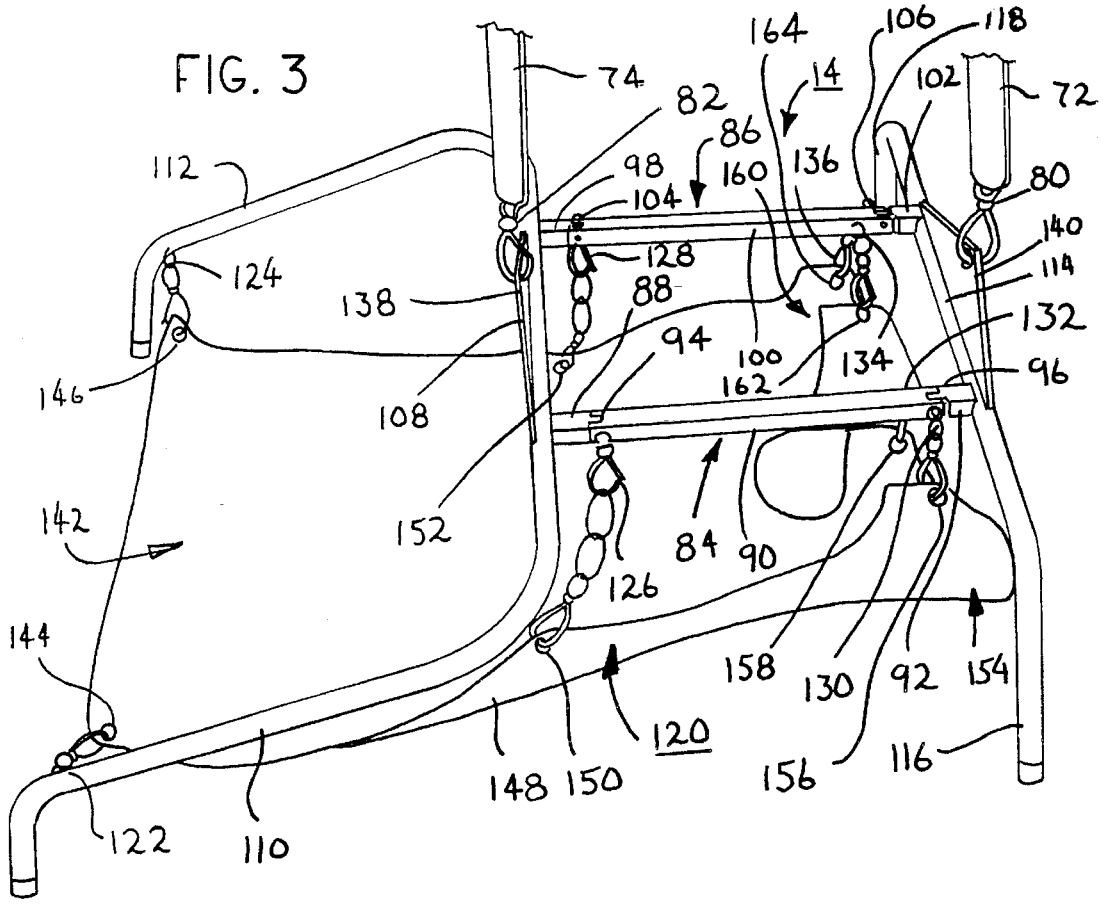
FIG. 3 is a perspective view of the sling frame.
Figure 4:
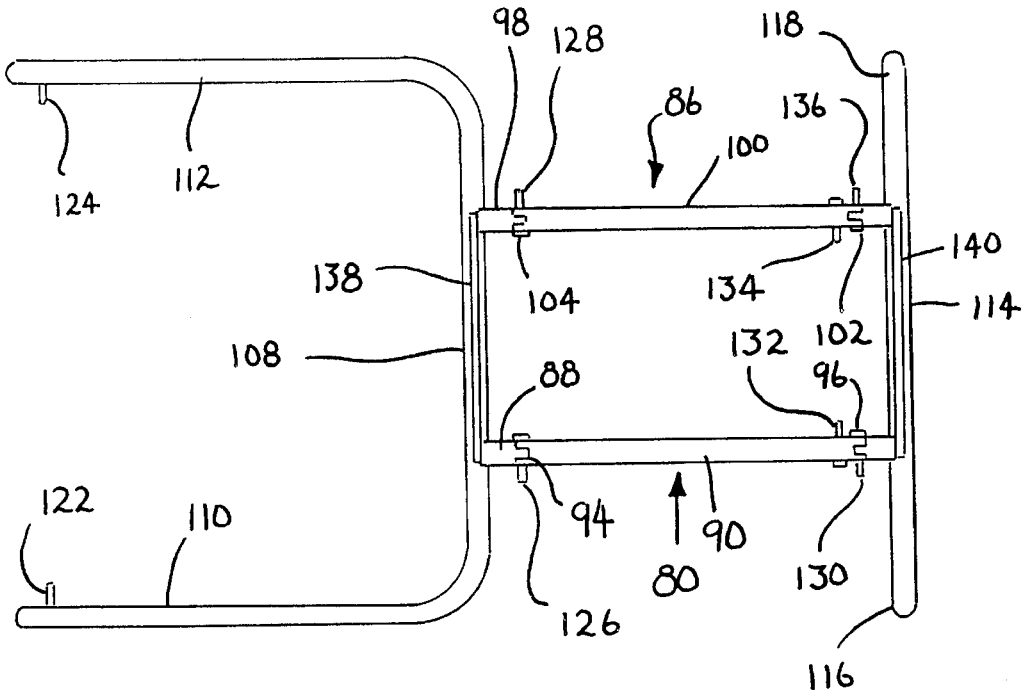
FIG. 4 is a top view of the sling frame.

As best seen in FIGS. 3 and 4, sling frame 14 includes a central framework formed of a pair of spaced, substantially horizontal bars, generally 84 and 86. Bar 84 includes an upper section 88, a central section 90, and a lower section 92. Sections 88 and 90 are connected with hinge 94, while sections 90 and 92 are connected with hinge 96. Similarly, bar 86 includes an upper section 98, a central section 100, and a lower section 102. Sections 98 and 100 are connected with hinge 104, while sections 100 and 102 are connected with hinge 106. In the preferred embodiment, the hinges are one-way hinges which fold only in one direction and are rigid in the other direction.

The upper ends of bars 84 and 86 are joined by bar 108, which has ends that curve downwardly to form upper legs 110 and 112. Similarly, the lower ends of bars 84 and 86 are joined by bar 114, which has ends curving downwardly to form lower legs 116 and 118.

Sling frame 14 also includes a plurality of snap fasteners for use in attaching a sling 120 beneath frame 14. Specifically, frame 14 includes fasteners 122 and 124 on legs 110 and 112, respectively, fasteners 126 and 128 on bars 84 and 86, respectively, adjacent their upper ends, and fastener pairs 130, 132 and 134, 136 on bars 84 and 86, respectively, near their lower ends. An upper attachment means 138 and a lower attachment means 140 longitudinally spaced relative to each other, each with a fastener opening therein, extend upwardly from the ends of bars 84 and 86 to provide a means for attaching fasteners 80 and 82 to thereby provide a two point connection means between the sling frame and the hoist assembly.

Sling 120 includes a canvas fabric that includes a head section 142 connectable to fasteners 122 and 124 with grommets 144 and 146, respectively; a trunk section 148, connectable to fasteners 126 and 128 with grommets 150 and 152, respectively; a first leg section 154 connectable with grommets 156 and 158 to fastener pair 130, 132; and a second leg section 160 connectable with grommets 162 and 164 to fastener pair 134, 136.

In transferring an invalid from a horizontal position, such as from a bed surface, to a sitting position, such as in a wheelchair, sling 120 is placed beneath the invalid, with the invalid's head resting on head section 142, the invalid's trunk on section 148, the invalid's right leg on section 154, and the invalid's left leg on section 160. Fasteners 122–136 are then snapped into corresponding grommets to connect sling 120 to sling frame 14. Sling frame 14 is, in turn, connected to bands 72 and 74 by snapping fasteners 80 and 82 into the holes in attachment means 138 and 140, respectively. Motors 66 and 68 are then energized using control box 70, to extend screw shafts 58 and 60, respectively. As shafts are extended, wheeled clamps 54 and 56 move outwardly along track 40, pulling bands 72 and 74 upwardly over pulleys 76 and 78, respectively. As a result, the patient is lifted from the bed surface, as illustrated in FIG. 5, permitting movement away from the bed by moving hoist assembly 12 along rails 16 and 18 to position the invalid over the second position.

Figure 7:
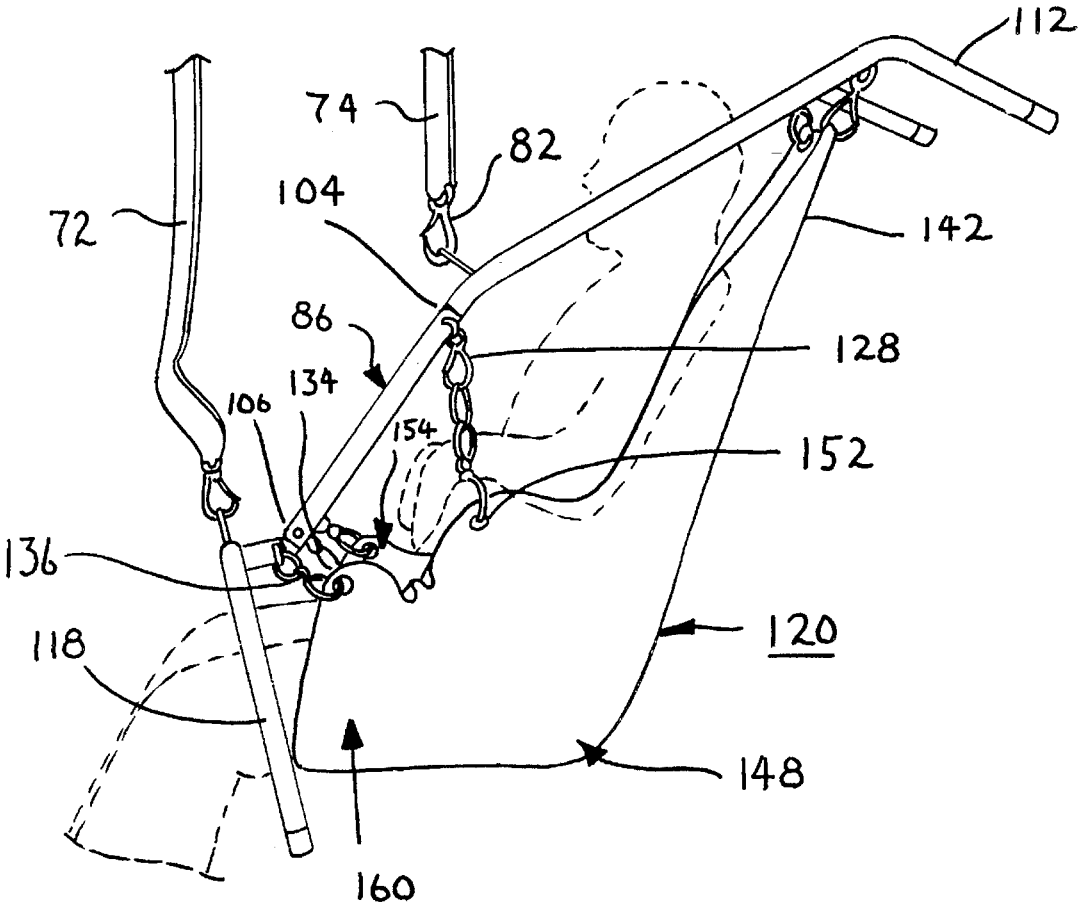
FIG. 7 illustrates the sling frame with an invalid in a sitting position.

The speeds of motors 66 and 68 are then controlled so that band 72 is retracted relatively more than band 74. Therefore, the upper end of frame 14 is raised higher than the lower end of frame 14, bringing the invalid to the position shown in FIG. 6. In this position, lower legs 116 and 118 continue to extend downward due to shifting of the sections of bars 84 and 86 relative to each other at hinges 94 and 96 on bar 84, and hinges 104 and 106 on bar 86. Further greater movement of band 72 brings the invalid to the sitting position shown in FIG. 7, permitting positioning of the invalid in the wheelchair. Since lower legs 116 and 118 are hinged to continue to extend in a downward direction, they do not interfere with placement of the invalid in the chair.

Certain modifications and improvements will occur to those skilled in the art upon a reading of the foregoing description. By way of example, two pairs of bands may be used to support the sling frame or the apparatus can be arranged to move the invalid from the end of the bed instead of the side. Also, motors could be added to the overhead frame to allow the invalid to operate the lift by himself. It should be understood that all such modifications and improvements have been deleted herein for the sake of conciseness and readability but are properly within the scope of the following claims.

I claim:

1. An apparatus for moving an invalid between first horizontal and second sitting positions, said apparatus comprising:

(a) an overhead frame extending over said first and second positions;

(b) a hoist assembly supported by said frame, said assembly including independently operable first and second retractable sling frame supports; and (c) a sling frame having a two point connection to the hoist assembly, comprised of longitudinally spaced, upper and lower frame attachments to connect said sling frame to said frame supports and sling attachments to connect a sling beneath said frame.

2. The apparatus according to claim 1, further including a sling attached beneath said sling frame.

3. The apparatus according to claim 2, wherein said sling includes a head support section, a trunk support section, and a pair of leg support sections.

4. The apparatus according to claim 1, wherein each of said sling frame supports include a band having an upper end joining said hoist assembly and a lower end connected to a frame attachment.

5. The apparatus according to claim 1, wherein said hoist assembly includes a track, first and second band clamps, first and second drive means adapted to move said first and second band clamps along said track, and first and second bands having upper ends held by said band clamps and downwardly extending lower ends.

6. The apparatus according to claim 5, wherein said first and second drive means include first and second screw shafts having outer ends attached to said first and second band clamps and inner ends attached to first and second motors adapted to extend or retract said shafts.

7. The apparatus according to claim 1, wherein said overhead frame includes spaced, horizontal rails and said hoist assembly is adapted to move along said rails.

8. The apparatus according to claim 7, wherein said hoist assembly track extends between said rails.

9. A sling frame for an apparatus for moving an invalid between first horizontal and second sitting positions, said apparatus including an overhead frame extending over said first and second positions and a hoist assembly supported on said frame, said sling frame comprising:

(a) a central framework with opposed upper and lower ends and parallel sides joining said upper and lower ends;

(b) longitudinally spaced, upper and lower attachments to connect said sling frame to said hoist assembly;

(c) upper and lower support legs pivotally attached to said central framework and adapted to rest on a surface at said first horizontal position; and (d) sling attachments to connect a sling beneath said frame.

10. The apparatus according to claim 9, wherein said lower legs are attached to the lower end of said central framework and said upper legs are attached to the upper ends of said central framework.

11. The apparatus according to claim 10, wherein said sling frame is hinged to allow said lower legs to selectively move between first and second positions.

12. An apparatus for moving an invalid between first horizontal and second sitting positions, said apparatus comprising:

(a) an overhead frame extending over said first and second positions;

(b) a hoist assembly supported by said frame, said assembly including independently operable first and second retractable sling frame supports;

(c) a sling frame, said sling frame including:

(i) a central framework with opposed upper and lower ends and parallel sides joining said upper and lower ends;

(ii) longitudinally spaced, upper and lower attachments to connect said sling frame to said hoist assembly at two points;

(iii) upper and lower support legs attached to said central framework and adapted to rest on a surface at said first horizontal position; and (iv) sling attachments to connect a sling beneath said frame; and (d) a sling attached beneath said sling frame.

13. The apparatus according to claim 12, wherein said sling includes a head support section, a trunk support section, and a pair of leg support sections.

14. The apparatus according to claim 13, wherein said head support section is attached to said upper legs, said trunk support section is attached to the upper end of said central framework, and said leg support sections are attached to the lower end of said central framework.

15. The apparatus according to claim 12, wherein each of said sling frame supports include a band having an upper end joining said hoist assembly and a lower end connected to a frame attachment.

16. The apparatus according to claim 12, wherein said hoist assembly includes a track, first and second band clamps, first and second drive means adapted to move said first and second band clamps along said track, and first and second bands having upper ends held by said band clamps and downwardly extending lower ends.

17. The apparatus according to claim 16, wherein said first and second drive means include first and second screw shafts having outer ends attached to said first and second band clamps and inner ends attached to first and second motors adapted to extend or retract said shafts.

18. The apparatus according to claim 12, wherein said overhead frame includes spaced, horizontal rails and said hoist assembly is adapted to move along said rails.

19. The apparatus according to claim 18, wherein said hoist assembly track extends between said rails.

20. The apparatus according to claim 12, wherein said lower legs are attached to the lower end of said central framework and said upper legs are attached to the upper ends of said central framework.

21. The apparatus according to claim 20, wherein said sling frame is hinged to allow said lower legs to selectively move between first and second positions.

* * * * *